US009181711B2

(12) United States Patent
Bordener

(10) Patent No.: US 9,181,711 B2
(45) Date of Patent: Nov. 10, 2015

(54) BRACKET, KIT AND ASSEMBLY FOR DECORATIVE MOUNTED PANELS

(71) Applicant: Robert B. Bordener, Bloomfield Hills, MI (US)

(72) Inventor: Robert B. Bordener, Bloomfield Hills, MI (US)

( * ) Notice: Subject to any disclaimer, the term of this patent is extended or adjusted under 35 U.S.C. 154(b) by 0 days.

(21) Appl. No.: 14/249,984

(22) Filed: Apr. 10, 2014

(65) Prior Publication Data

US 2014/0290166 A1 Oct. 2, 2014

Related U.S. Application Data

(63) Continuation-in-part of application No. 13/672,806, filed on Nov. 9, 2012, now Pat. No. 8,984,838.

(60) Provisional application No. 61/816,528, filed on Apr. 26, 2013, provisional application No. 61/654,452, filed on Jun. 1, 2012, provisional application No. 61/557,625, filed on Nov. 9, 2011.

(51) Int. Cl.
*E04F 13/08* (2006.01)

(52) U.S. Cl.
CPC ..... *E04F 13/0882* (2013.01); *E04F 13/083* (2013.01); *E04F 13/0803* (2013.01)

(58) Field of Classification Search
CPC ... E04F 13/08; E04F 13/0803; E04F 13/0805; E04F 13/083; E04F 13/0832; E04F 13/0882
USPC ..... 52/506.05, 506.06, 510, DIG. 13
See application file for complete search history.

(56) References Cited

U.S. PATENT DOCUMENTS

| | | | | | |
|---|---|---|---|---|---|
| 3,063,498 | A | * | 11/1962 | Ford | 160/370.1 |
| 3,621,635 | A | * | 11/1971 | De Lange | 52/235 |
| 4,117,641 | A | | 10/1978 | Wells | |
| 4,841,690 | A | * | 6/1989 | Commins | 52/105 |
| 5,417,020 | A | * | 5/1995 | Dobija | 52/235 |
| 5,505,029 | A | | 4/1996 | Lind | |
| 5,953,878 | A | | 9/1999 | Johnson | |
| 5,974,753 | A | * | 11/1999 | Hsu | 52/506.01 |
| 5,979,124 | A | * | 11/1999 | Branan | 52/136 |
| 6,098,364 | A | * | 8/2000 | Liu | 52/506.08 |
| 6,202,377 | B1 | | 3/2001 | Krieger | |
| 6,289,646 | B1 | * | 9/2001 | Watanabe | 52/506.01 |
| 6,308,475 | B1 | * | 10/2001 | Crish et al. | 52/204.597 |
| 6,427,408 | B1 | | 8/2002 | Krieger | |
| D464,153 | S | * | 10/2002 | Krieger | D25/136 |
| 7,096,629 | B1 | * | 8/2006 | Cox | 52/235 |
| 7,562,509 | B2 | * | 7/2009 | Ness | 52/800.11 |
| 7,805,899 | B2 | * | 10/2010 | Montgomery | 52/235 |
| 7,836,646 | B2 | | 11/2010 | Matsufuji | |
| 8,151,533 | B2 | | 4/2012 | Krieger | |

(Continued)

FOREIGN PATENT DOCUMENTS

| | | | | |
|---|---|---|---|---|
| DE | 2618153 | A1 * | 11/1977 | |
| DE | 102008024992 | A1 * | 11/2009 | E04F 13/08 |

*Primary Examiner* — James Ference
*Assistant Examiner* — Charissa Ahmad
(74) *Attorney, Agent, or Firm* — Dinsmore & Shohl LLP; Douglas J. McEvoy

(57) ABSTRACT

An assembly for securing a panel to a wall surface, including an elongated rail adapted to being secured in extending fashion along the wall surface and a clip adapted to being secured to a rear surface of the panel. The rail and clip each exhibit a similar cross sectional profile, with each including at least one mating and inclined support surface for redirecting a weight of the panel inwards toward the wall surface.

14 Claims, 8 Drawing Sheets

(56) References Cited

U.S. PATENT DOCUMENTS

| | | | | |
|---|---|---|---|---|
| 8,191,327 | B2 | 6/2012 | Griffiths et al. | |
| 8,322,102 | B2 | 12/2012 | Krieger | |
| 8,359,811 | B2 * | 1/2013 | Muller | 52/747.12 |
| 8,407,955 | B2 | 4/2013 | Delforte | |
| 8,511,014 | B2 | 8/2013 | Delforte | |
| 2002/0023398 | A1 * | 2/2002 | Ito | 52/220.1 |
| 2004/0200161 | A1 * | 10/2004 | Liu | 52/235 |
| 2006/0179764 | A1 * | 8/2006 | Ito | 52/506.06 |
| 2009/0241458 | A1 * | 10/2009 | Das | 52/519 |
| 2012/0151861 | A1 * | 6/2012 | Mulhair | 52/506.05 |
| 2012/0167523 | A1 | 7/2012 | Krieger | |
| 2012/0186170 | A1 * | 7/2012 | Macdonald et al. | 52/173.3 |
| 2012/0285112 | A1 * | 11/2012 | Kan | 52/588.1 |

* cited by examiner

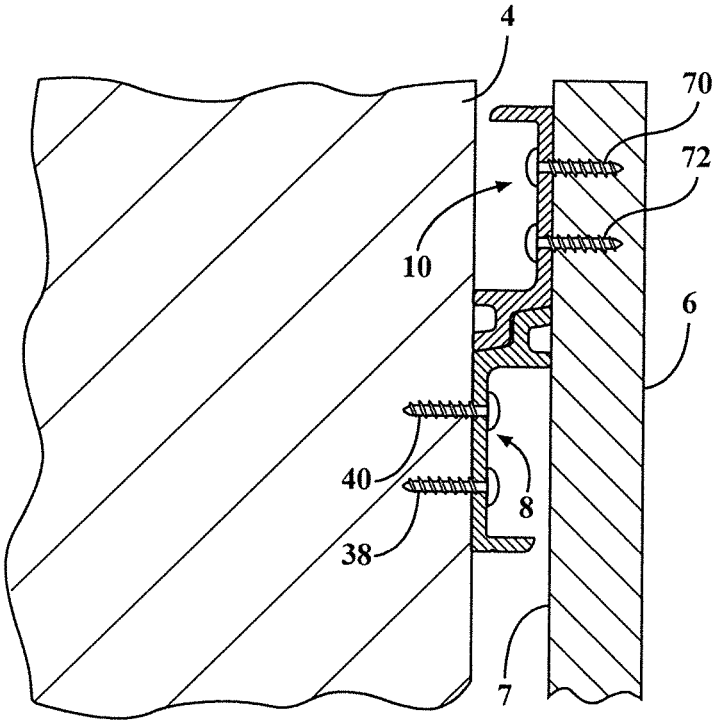
FIG. 5
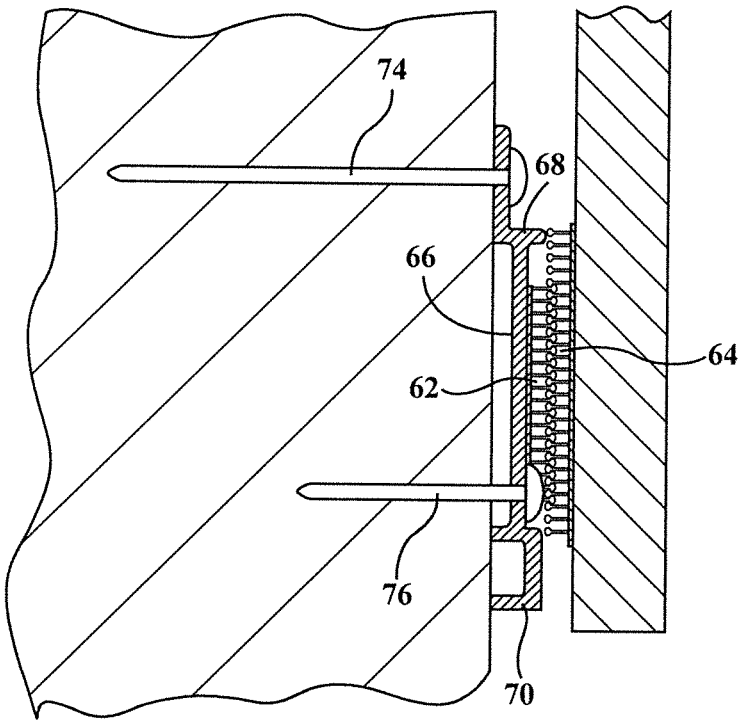

BRACKET, KIT AND ASSEMBLY FOR DECORATIVE MOUNTED PANELS

CROSS REFERENCE TO RELATED APPLICATIONS

This application claims the benefit of U.S. Provisional Application 61/816,528 filed on Apr. 26, 2013. This application is a Continuation-in-part of application Ser. No. 13/672,806 filed on Nov. 9, 2012. Application Ser. No. 13/672,806 claims the benefit of U.S. Provisional Application 61/654,452 filed on Jun. 1, 2012. Application Ser. No. 13/672,806 claims the benefit of U.S. Provisional Application 61/557,625 filed on Nov. 9, 2011, the contents of which are incorporated herein in their entirety.

BACKGROUND OF THE INVENTION

1. Field of the Invention

The present invention discloses a system, kit assembly, and installation process for securing and aligning panels in spaced fashion relative to a wall surface. A profile attachment scheme is established between elongated rails, which are secured to the wall surface, with additional (typically sectioned lengths of rails) clips having identical profiles screwed or otherwise attached to the rear surfaces of a plurality of panels prior to engaging the rails. In this fashion, the clips inter-engage the rails in an opposing and horizontally lengthwise extending and supporting manner so that panels can be either fixedly or individually removable relative to the wall surface.

The present inventions additionally provide an array of features, including unique attachment mechanisms for transferring and distributing both stresses and panel weight across a wider surface area of each panel. Further, the system provides several unique means for securing panels in a variety of ways depending on the installation requirements, such including the panels being supported in such a manner that their thermal coefficient of expansion/contraction (such being endemic to given installation environments) will not otherwise result in warping or buckling of the panels at their mounting interfaces or causing any undesired movement or stress accumulation within the completed installation.

The various configurations depicted herein also provide a maximum of air circulation behind the panels and which assist in avoiding mold or other environmental degradation. The system, kit and assembly additionally offers unique advantages over the prior art including faster installation time, drastically reduced parts count and inventory requirement, the option of individually demounting installed panels, faster and simpler alignment of panels over uneven walls, sound absorption of both high and low frequency noise, interchangeability of decorative moldings, reduced materials cost, reduced installation cost, and drastically superior ability to absorb building movement including a unique provision for individual panel demounting.

The inventive panel bracket and system also allows for the option of accommodation for building movement while providing for simultaneous stable panel bearing support without disturbing other elements of the installed array of panels. Movement of architectural components occurs either during normal seasonal movement of the building, or in the natural expansion and contraction of the panels themselves by varying conditions of temperature, vibration, moisture, or humidity. Additionally, the present system avoids the requirement for machining the edges of the panels and provides several different mounting methods within the same system, while maintaining a unique mix of features and benefits not previously known in the art.

2. Background of the Relevant Art

Architectural panels are well-known in the art. Such panels differ from most wall coverings in that they typically feature mechanical attachment of some sort, or at the very least offer a thickness exceeding typical wallpaper-type coverings and are therefore generally ¼" thick or greater, and are most commonly 5/16", 3/8", ½" and up to 1" in thickness.

Such panel systems are typically employed to conceal building wall irregularities and to protect and decorate wall surfaces in offices, hospitals, retail spaces, and building interiors. The panels are most commonly offered in wood grain, metallic, simulated grass, and other faux finishes. Substrate materials are most commonly plywood, wood flour, solid phenolic composite, gypsum or other mineral (e.g. magnesium oxide, Portland cement) board, plastic, or combinations thereof.

Additional examples from the prior art include the panel attachment systems depicted in each of U.S. Pat. Nos. 6,427,408, 8,151,533 and 6,202,377, all to Krieger. In the Krieger, '533 reference, a modular wall system includes a number of decorative panels that are received in an extruded panel frame. Each of the frames are positioned by connecting them to a wall rail that is attached to the building. The wall rail and panel frame each have a groove that accepts a fastener or clip by interference or snap fit to attach the panel frame to the wall rail. The grooves have a dove-tail shape that permits a snap fit to secure the panels, while permitting the panels to be easily removed or reconfigured.

In each of the Krieger '408 and '377 references, the wall system includes a plurality of rectangular rigid prefinished panels mounted on a wall support structure with main runners and cross runners. The main runners serve to lock the panels onto the support structure and with the cross runners serving to prevent the wood-based panels from warping due to adverse moisture conditions. The main runners are configured to space the panels from the wall support structure to encourage uniform humidity conditions at the front and rear of the panels. Clips that secure the panels to the main runners are fixed adjacent the top and bottom panel edges at different setoffs to obtain an advantageous nesting of panels for reduced packaging volume.

SUMMARY OF THE PRESENT INVENTION

The present invention discloses a mounting bracket, provided as identically cross sectional shaped and sub-wall mounted rails and panel reverse face mounted clips, and which is incorporated into an improved panel mounting system and installation process which uniquely allows individual panel demount ability and focuses panel weights towards the structural support of the wall surface, the while simultaneously maintaining suspension of the panel weight and for allowing the panels to individually expand or contract, such as according to a given coefficient of thermal expansion associated with the panel being situated within a given environment. Without limitation, the panel edges may be engaged at any of a variety of angles.

A further distinguishing feature of the present system is that a non-horizontal orientation of the two bearing surfaces of the bracket, such as defined by ramped engaging surfaces established between a pair of nesting "U" shaped portions associated with the rail and clip. The typical angle of the two bearing surfaces is 10° (downward relative to a horizontal and toward the sub-wall), but can be any angle not limited to one desired range of between 5° to 20.

Additional variants associated with the present assembly include providing for individually demountable panels while using inexpensive reclosable fasteners such as 3M Dual Lock or Velcro and other reclosable fasteners, which are individually mounted as adhesive strips to each of inner faces of the panels and opposing outer faces of surface mounted profile extrusions which are screw-attached to the sub wall. Such plastic Velcro and friction-type reclosable fasteners can be without limitation employed along the lower and/or side edges of each panel, with the nesting rail and clip utilized along upper extending locations of the mounted panel. A further variation envisions the use of rubber isolated batten strips filling in a center field between a pair of panels in a cost-effective installation with damping for high and low frequency vibrations (see co-pending application).

Individually demountable panels may also be suspended in the main field if each panel with the clip and rail components engaged in single or multiple rows. Further each row may face the same direction or the uppermost row may face in the opposite direction thereby locking the panel in place and precluding it from being demounted until it is unlocked.

Any of the profile configurations depicted herein can also exhibit at least one surface which is either flush with or spaced a distance from a sub-wall surface of the room (this defined as such as the underlying wallboard or drywall material covering the joists and to which the decorative panel assembly is mounted). In given applications, a sub-wall separation distance of a panel supporting profile can be less than an additional distance that may be accommodated by a reclosable fastener without disengaging therefrom. Additional features can include the inventive bracket (rail and clip) being used in combination with any of the prior disclosure materials.

BRIEF DESCRIPTION OF THE DRAWINGS

Reference will now be made to the attached drawings, when read in combination with the following detailed description, wherein like reference numerals refer to like parts throughout the several views, and in which:

FIG. 5 is a side plan illustration of a mounting illustration similar to that shown in FIG. 1;

DETAILED DESCRIPTION OF THE INVENTION

With reference to the succeeding illustrations, the panel system and kit according to the several embodiments described herein provides bearing support for a plurality of panels assembled in a decorative supported array upon a wall and in such a way that the panels are permitted to expand or contract according to their determined thermal coefficient, such as resulting from a given set of environmental conditions. As is also known, extended running lengths of assembled panels and the underlying grid configured profiles required for mounting the panels can multiply the degree of expansion or contraction, such as varying in intensity or degree over a significant time elapse not limited to changing of seasons, with the result being that an anticipated set of dimensional changes not anticipated for in the original installation can result in warpage, panel expansion, buckling panel cracking, delamination, or inadvertent disengagement of the panels from the underlying support structure.

As will be further described below, the present invention provides each of fixed and individually demountable panel assemblies, the latter permitting individual panels to be demounted from the wall assembly at any time without interfering with the remaining panel installation. Additional features of the present system and assembly include the ability to bear all a given panel weight within a very small area of the panel, combining the inventive bracket with reclosable fasteners or other high coefficient of friction plastics or rubbers to additionally secure each panel from accidental demounting, combining the inventive bracket with battens in the main field to allow airflow and reduce overall cost and dampen vibrations, and combing the inventive bracket with the various trim components of the prior co-pending systems for reveal, corner, and edge trims.

Figure 1:
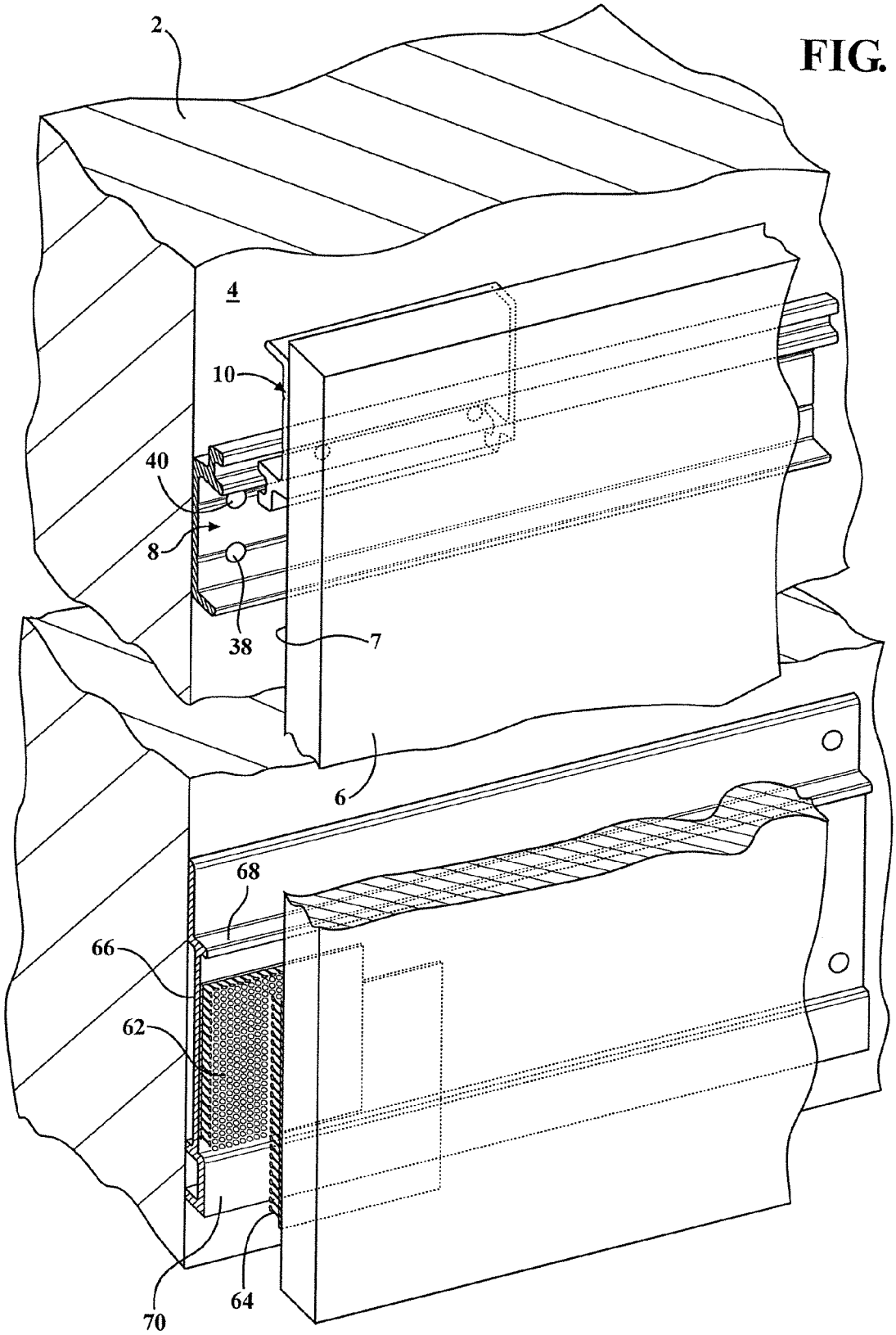
FIG. 1 is a perspective view of the system, kit and assembly according to one non-limiting variant of the invention and which illustrates, in reduced length fashion, a selected installation including a rail mounted to an exterior surface of a sub-wall and an opposing clip having an identical cross sectional profile and which is secured to an inner surface of a panel, opposing pluralities of reclosable portions being arranged upon the wall surface and inner panel surface at additional aligning locations and which, in combination with the opposing rail and clips, provide for demount-ability of the panel.

The above said, and referring initially to FIG. 1, a perspective view is shown of a system, kit and assembly according to one non-limiting variant of the invention. A sub-wall 2 is depicted and includes a wall surface 4, upon which is illustrated (in reduced height fashion) a selected panel 6, such as typically exhibiting a rectangular planar shape with a specified thickness. The panel 6 can be constructed of any material and provided with any decorative appearance as well as functional properties, not limited to acoustical dampening or insulation.

Figure 2A:
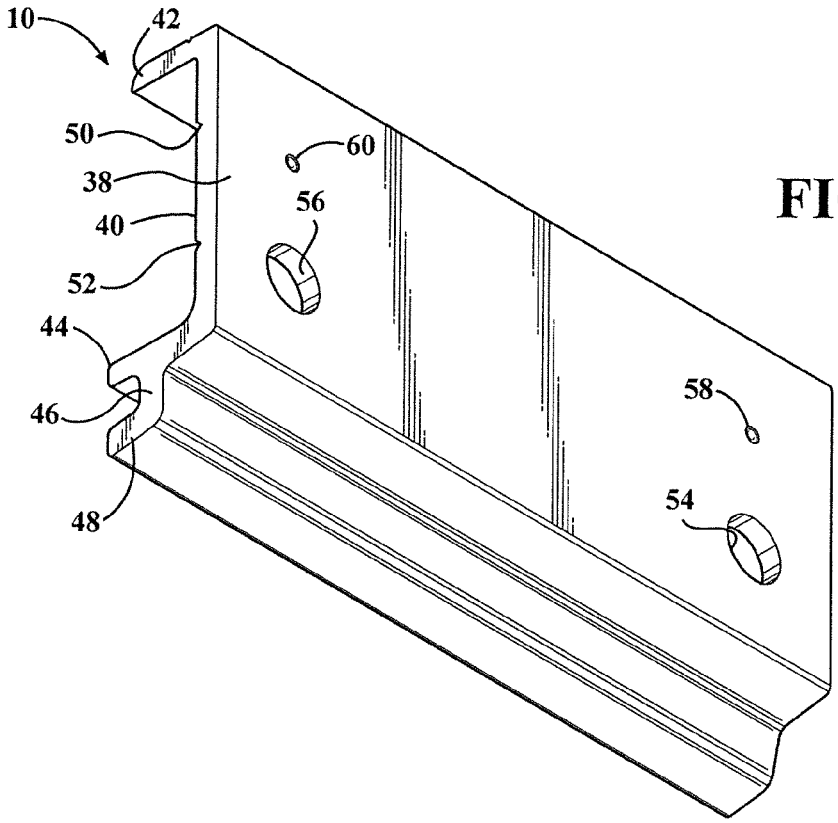
FIG. 2A is a perspective of a panel mounting clip such as shown in FIG. 1.
Figure 2B:
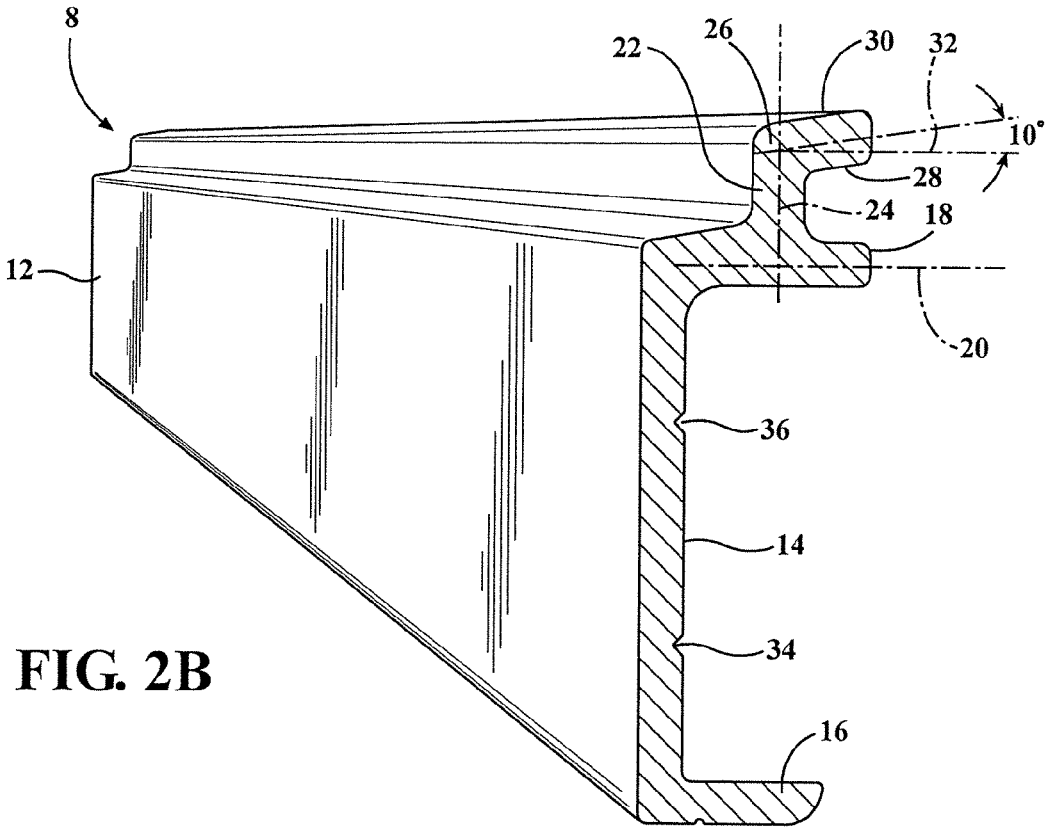
FIG. 2B is an end perspective of the sub-wall mounted rail of FIG. 1.
Figure 3:
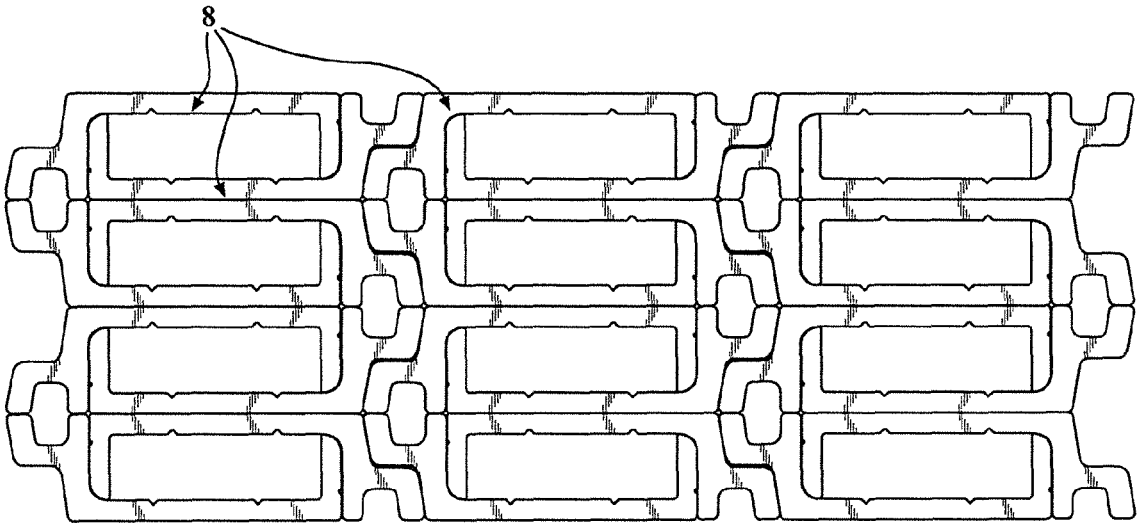
FIG. 3 is a packing arrangement in end profile of a plurality of rails and which illustrates the inter-supporting aspects provided by the nesting of the rails in the mariner shown, such providing stability and strength during shipping and handling.

A feature of the invention is the provision of a plurality of inter-engaging or inter-supporting brackets, these initially depicted by rails 8 (also FIG. 2B) and clips 10 (also FIG. 2A). The rails 8 are typically formed of elongated lengths of material, such as an aluminum or steel extrusion, and which can be provided in any running length of eight feet or longer. Also, and while a single clip 10 is shown in FIG. 1, it is understood that any number of clips can be arranged such as in horizontally spaced fashion along the rear surface (at 7) of the panel. As further shown in FIG. 3, a packing arrangement is shown in end profile of a plurality of rails 8, and which illustrates the inter-supporting aspects provided by the nesting of the rails in the manner shown, such providing stability and strength during shipping and handling.

Referring again to FIG. 2B, the rail is again generally depicted at 8 and includes a main planar body having an exterior surface 12 and an interior surface 14. An inwardly angled edge or lip 16 is configured along one length extending end. An engagement profile extends from and along the other length extending end of the rail and includes a generally "U" shaped profile which is displaced a distance inwardly from the interior surface 14 via an inner ledge 18, which includes a centerline 20 establishing a perpendicular with the main surfaces 12 and 14.

A connecting web 22 of the "U" shaped profile extends upwardly from a midpoint of the inner ledge 18 and likewise includes a centerline 24 establishing a perpendicular with the inner ledge centerline 18 (and by extension a parallel with the surfaces 12/14 of the main body. An outer ledge 26 is provided and includes a slightly outwardly angled profile relative to the inner ledge 18, this best depicted by inner and outer tapered surfaces 28 and 30 which are reflected by surface axes which extend at angle (such as 10°) relative to a horizontal line 32 (parallel to line 20) taken through a central location of the outer ledge 26. Additional features associated with the rail include such as "V" notched drill lines 34 and 36, this in order to facilitate application of mounting fasteners (see further at 38 and 40 in FIG. 1) for securing the rail 8 in the manner best shown in FIG. 1.

Figure 2C:
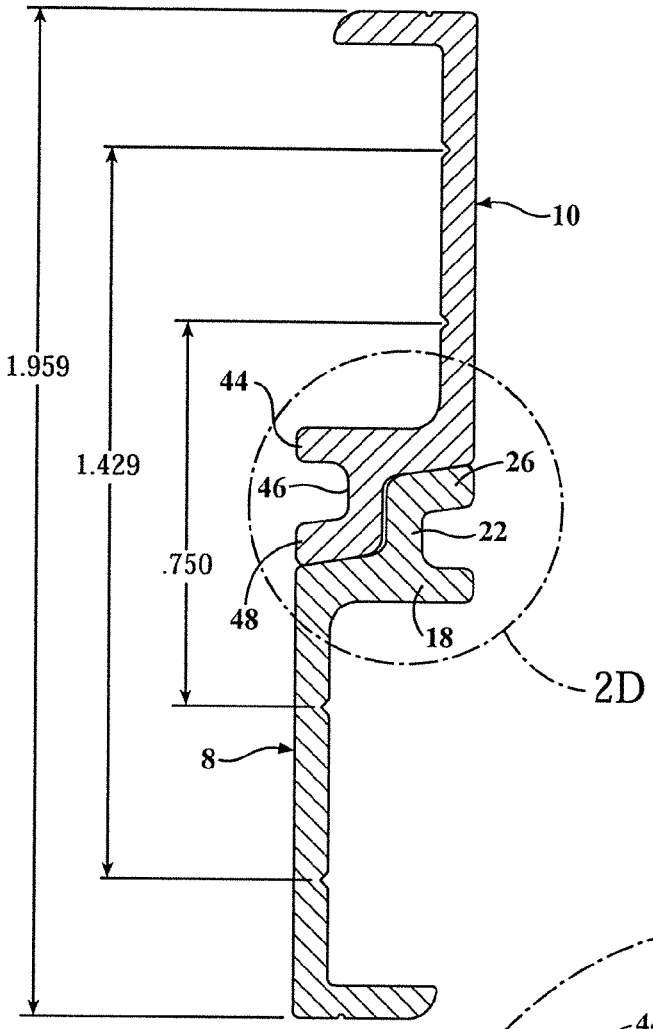
FIG. 2C is a side plan view illustrating the engagement scheme taken from FIG. 1 and established between the sub-wall secured rail and inner panel surface secured clip.

FIG. 2A again is an illustration of a clip 10 and which exhibits, as best shown in FIG. 2C, a cross sectional profile identical to that associated with the rail 8 and exhibits exterior 38 and interior 40 surfaces, a first edge extending and inwardly angled lip 42 and an opposite edge extending and generally "U" shaped profile including inner ledge 44, connecting web 46 and outer ledge 48. Additional notched locations (at 50 and 52) are defined in linear extending fashion along the inner surface 40 of the clip 10 for receiving additional mounting fasteners (not shown) for securing to the inner face of the panel 6 (see again FIG. 1).

To facilitate this mounting arrangement, mounting apertures can also be defined in the clips 10, see inner perimeter rim surfaces 54 and 56, such as coinciding in location with a selected one 52 of the "V" shaped recess notches. Notch indicating locations, at 58 and 60, are also referenced on the exposed surface 38 of the clip 10 and provide an optional feature for facilitating use of the mounting assembly in a reverse locking configuration as will be subsequently described.

Additional to providing a plurality of individually pre-sized clips (such as which may be pre-attached to the reverse face of a suitable plurality of panels in a desired mounting application) it is also envisioned that a plurality of rails 8 can be shipped (such as again shown in FIG. 3), with a selected subset number of the rails fabricated/sectioned into individual lengths (such as without limitation 2-3 inches apiece) in order to subsequently function as clips. As further previously described in the illustration of FIG. 2A, the clips in their 2" long version, and as compared to the 96"-long version (AKA "rail 8) are pre-drilled in a precise manner such that an entire installation can be pre-fabricated with holes pre-drilled at a central location by a CNC machine.

FIG. 1 again references, in reduced length fashion, a selected installation including a rail 8 mounted to an exterior surface of a sub-wall 6 and an opposing clip 10 having an identical cross sectional profile and which is secured to an inner surface of the panel 6. Additional opposing pluralities of mating supports are depicted in a first variant as opposing pluralities of reclosable fastener portions, depicted at 62 and 64, and which are provided along lower aligning locations of the sub-wall 6 and panel 8. As further shown, the fasteners include individual and resistive inter-engaging portions such as which are produced by 3M® Corporation and sold under the commercial name Dual Lock™ Reclosable Fastener. The first plurality 62 of the reclosable portions are secured to an outer surface forming a portion of an intermediate positioned profile 66 which is in turn mounted to the sub-wall 4 in any manner desired, with the second plurality 64 of reclosable portions secured to the inner surface of the panel 6.

In combination with the reclosable portions 62 and 64, the elongated profile 66 depicted in FIG. 1 includes an upper projecting ledge 68 and a bottom projecting and raised support surface 70 (this further exhibited by a three-sided portion of the profile which exhibits a raised support surface) and which collectively define a frictional engaging and supporting relationship along the bottom of the panel to sub-wall interface which, in combination with the inter-supporting aspects of the rail 8 and clip 10, provide for individual demount-ability of the panel 6 from the sub-wall. FIG. 5 provides a cutaway plan illustration of the mounting arrangement as substantially shown in FIG. 1 and further referencing such features as additional mounting fasteners 70 and 72 for mounting the clip 10 to the desired location on the inner face of the panel 6, as well as the provisional of larger fasteners 74 and 76 for securing through aperture locations in the elongated profile 66 for mounting the same to the further intermediate and length extending location along with sub-wall 4. The sizing of the apertures 54 and 56 previously shown in FIG. 2A can further be such that redesigned screw heads of the associated mounting fasteners 70 and 72 can exhibit smaller diameters that fit into the apertures. The resulting gap therebetween providing further potential movement of a panel.

Figure 2D:
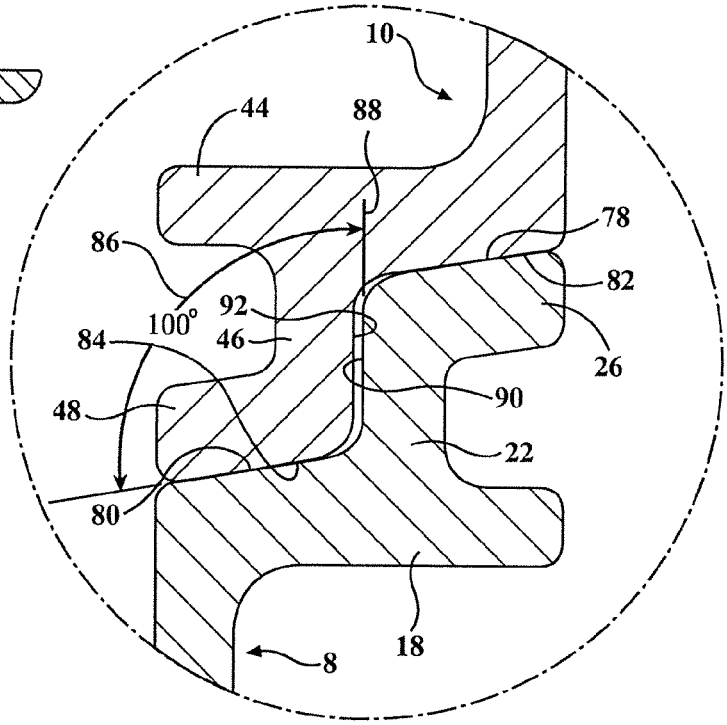
FIG. 2D is an enlarged partial view taken from FIG. 2C and better illustrating an example of a 100° angle formed between height extending support surfaces of said mating profiles and (downwardly) ramped engagement surfaces of the mating profiles in order to facilitate both weight distribution and direction towards the wall, a gap between the height extending support surfaces providing thermal coefficient compensation irrespective of expansion or contraction of the rail and clip bracketry, as well as compensating for settling of the wall.

Referring again to FIG. 2C, a side plan view is again shown illustrating the engagement scheme taken from FIG. 1 established between the sub-wall secured rail and inner panel surface secured clip. FIG. 2D is an enlarged partial view taken from FIG. 2C and better illustrating an example of a 100° angle formed between height extending support surfaces, see at 78 and 80 associated with the outer ledge 26 and inner connecting ledge (or web) 18 of the rail 8, with opposing mating surfaces referenced by an outer edge surface 82 of the ledge 44 of the upper supported clip 10 and offset outer surface 84 of the outer ledge 48.

As best shown in FIG. 2C, the opposing surfaces 78/82 and 84/80 are parallel to one another and are arranged in a fashion such that they defuse a (downwardly angled) ramped engagement, such as reference by an angle of 100° (see at 86) relative to a vertical axis 88 extending between height defining surfaces 90 and 92 associated with corresponding rear surfaces of the interconnecting webs or portions 22 and 46 of the overlapping "U" shaped profiles of the rail 8 and clip 10. Referring again to FIG. 2B, it is clearly seen that the 10° depicted between axis 32 and extended surfaces 28 and 30 of the rail outer ledge 26 corresponds to the 100° angle 86 in FIG. 2D. The angle 86 is further understood as capable of being modified to any range, such as between 91° to 179° (with 95°-115° being optimal), this in order to facilitate both weight distribution and direction of the weight of the panel 6 in a direction towards the sub-wall 4 and to in effect provide for self-tightening of the supported panels.

As also shown in FIG. 2D, a gap is depicted between the height extending support surfaces 90 and 92 established between the "U" shaped mounting portions of the clip and rail and, in one non-limiting variant, is 0.008" in dimension, this in order to provide thermal coefficient compensation irrespective of expansion or contraction of the rail and clip bracketry (such as resulting from a mounting arrangement in either a cold or warm weather location), as well as for additionally or alternatively providing misalignment compensating for settling of the sub-wall 4. In instances where a permanent mounting arrangement is desired, a silicone glue or other adhesive can be applied to the opposing surfaces 78/82 and 80/84 and in order to permanently affix the clip 10 to the rail 8.

Figure 4A:
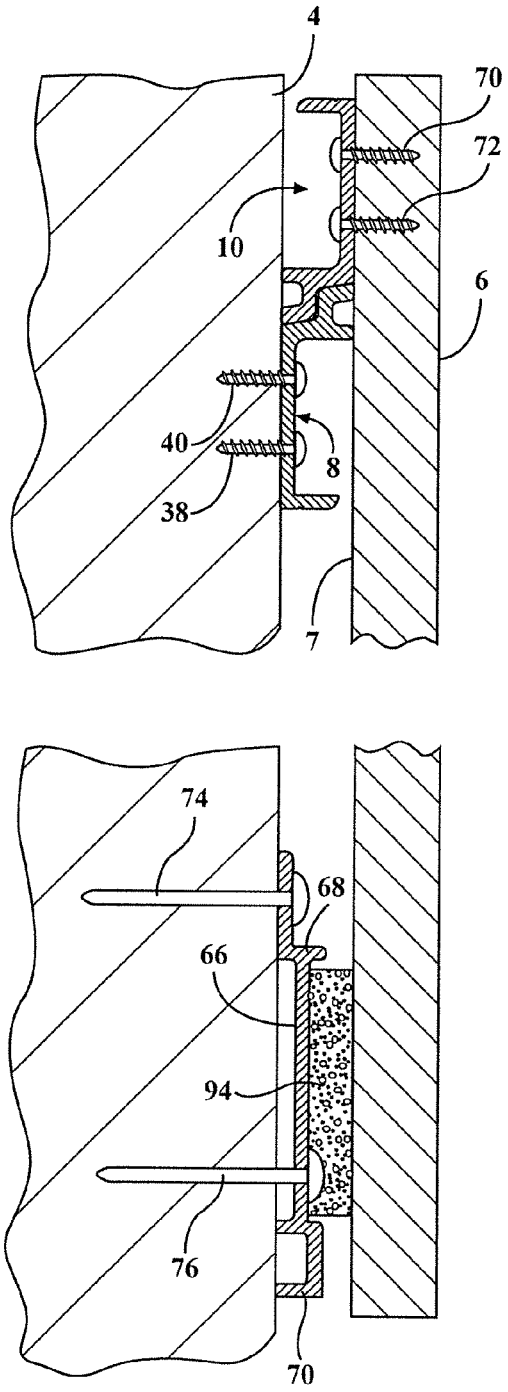
FIG. 4A is an illustration of a lift-off variant of demountable wall panel, exhibiting inter-engaging rails and clips similar to as shown in FIG. 1, and further depicting by non-limiting example a rubberized pad secured to an exterior surface of a sub-wall mounted bracket.

Beginning with FIG. 4A, a series of mounting arrangements are shown, each of which utilize an opposing relationship established between the sub-wall mounted rail 8 and panel secured clips 10, this in order to provide for each of individually de-mountable, temporarily locked or permanently locked variants in securing any arrangement of panels upon a wall surface. For purposes of ease of illustration, common features already described in reference to FIGS. 1-2D will not be repetitively described in each of the succeeding figure descriptions, with emphasis given instead to the combinations and arrangements of supporting hardware for facilitating either the fixed or removable arrangements.

Figure 4B:
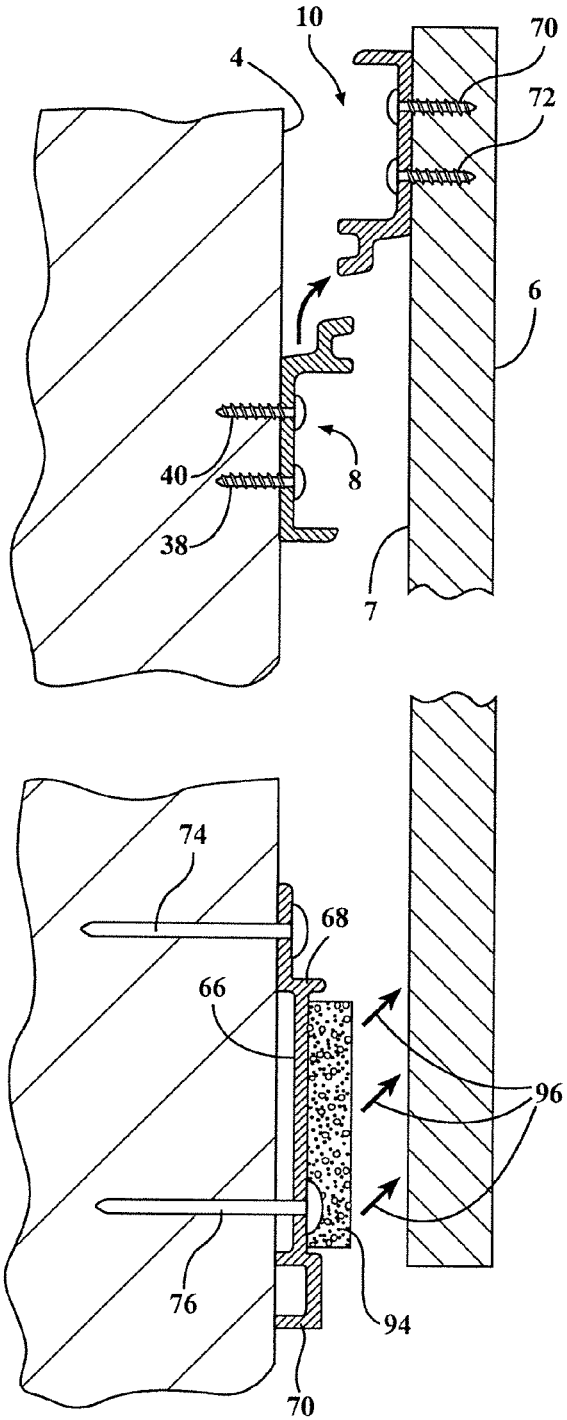
FIG. 4B is a succeeding illustration to FIG. 4A and depicting the panel in a lift-off position, enabled by the engagement height of the profiles being less than the horizontal spacing (vertically extending) gap established between tiers of panels.

Referring first to FIG. 4A, an illustration of a lift-off variant of demount-able wall panel, exhibiting inter-engaging rails and clips similar to as shown in FIG. 1, and further depicting by non-limiting example a further example of a mating or otherwise location biasing support in the form of a rubberized pad 94 secured to an exterior surface of a sub-wall mounted bracket, again a spaced distance from the rail to clip mounting arrangement which is the constant for every mounting configuration disclosed. In normal hanging support of the panel 6, the pad 94 exhibits a frictional engaging surface which cooperates with the nesting support established between the clip 10 and rail 8 and, in this fashion, provides for hanging support of the panel upon the wall. FIG. 4B is a succeeding illustration to FIG. 4A and depicts the panel 6 in a lift-off position (see also directional arrows 96), enabled by the engagement height of the profiles (surface 90 and 92 in FIG. 2D) being less than a corresponding horizontal spacing (vertically extending) gap established between successive vertically arranged tiers of panels. Obviously, multiple rows of engaged pairs of the inventive interlocking fasteners are envisioned in many instanced in addition to using only one pair.

Figure 6A:
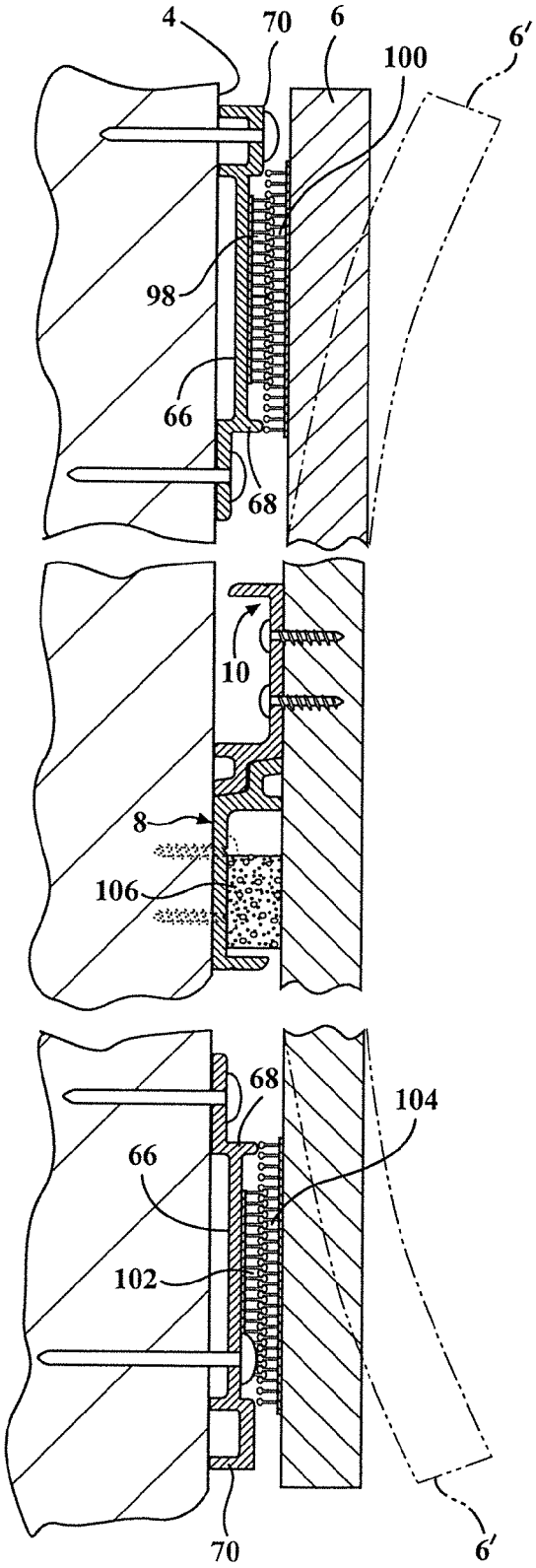
FIG. 6A is side plan illustration of a locking variant of a panel to wall mount arrangement and depicting a middle located pair of opposing rail and clip brackets, this in combination with upper and lower opposing pairs of reclosable portions for providing either of sliding or bending engagement of the panel onto the wall surface, a rubberized cushioning and dampening portion secured to an exposed surface of the wall mounted rail.

FIG. 6A is side plan illustration of a locking variant of a panel 6' to wall mount arrangement and depicting a middle located pair of opposing rail 8 and clip brackets 10, this in combination with upper 98/100 and lower 102/104 opposing pairs of reclosable portions for providing either of sliding or bending engagement of the panel 6' onto the wall surface. The pairs of reclosable portions are configured similar to those previously shown at 62 and 64 in FIGS. 1 and 5 and the provision of a pair of elongated profiles 66 are also exhibited in reversed fashion at extending locations both above and below the middle located arrangement of rail 8 and clips 10.

Figure 6B:
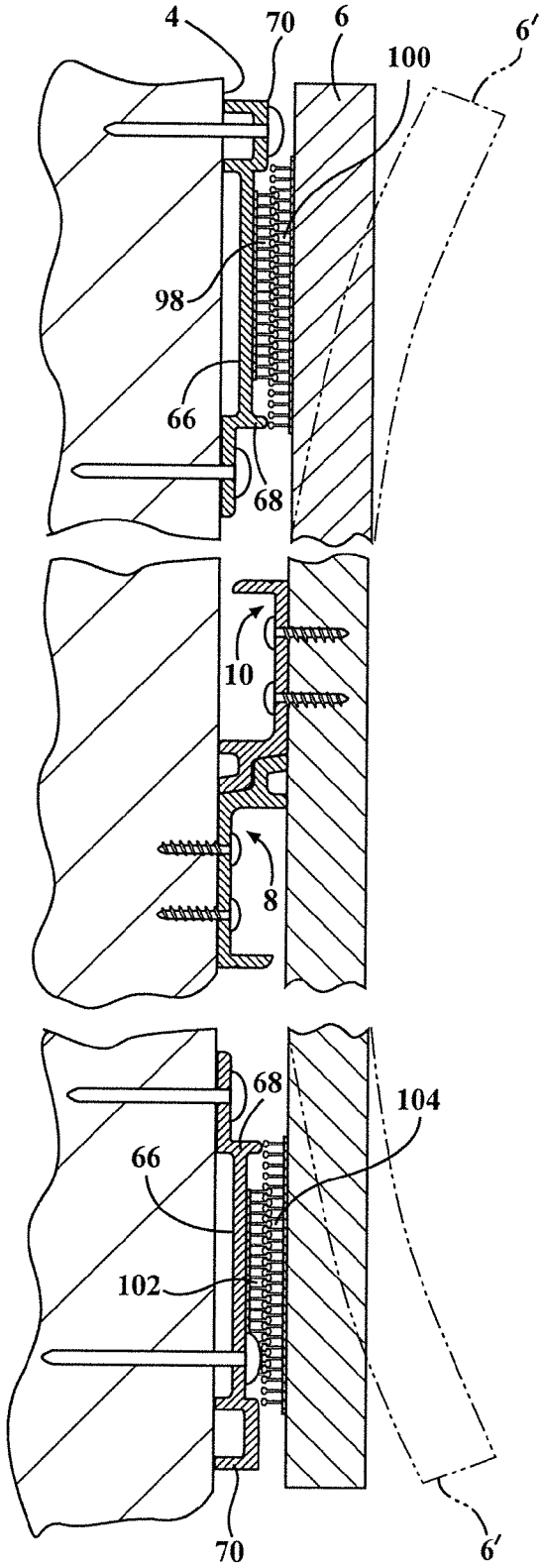
FIG. 6B is a substantially similar representation to that shown in FIG. 6A without the provision of the rubberized pad.

Also shown in FIG. 6A is a rubberized cushioning and dampening portion, at 106, and which is secured to an exposed surface (such as previously described at 14 in FIG. 2B) of the wall mounted rail, and which provides an additional degree of intermediate support to the rear surface 7 of the panel. The panel 6 depicted in FIG. 6A is further understood to possibly exhibit a degree of bend-ability or pliancy which allows for it to be bent, see upper and lower edges in phantom at 6', and in order to facilitate mounting of the panel to the sub-wall 4. FIG. 6B is a substantially similar representation to that shown in FIG. 6A without the provision of the rubberized pad.

In this variant shown, the flexible element integrated into each panel 6 can include such as a plastic pad between the rear face of each panel and the aluminum extrusion (e.g. clip 10) it is mounted to so that the panel will ideally yield slightly (e.g. again at 6') when an outside transverse load is applied to the panel and to further facilitate panel movement without stress such as when a panel may expand and partially overlap an adjacent exposed face of an extrusion. As also previously described, the 3M® Dual Lock® fasteners (102 and 104) each incorporate a flexible pad and reclosable fastener in one formed component. It is also understood that the desired reclosability can be achieved separately such as with conventional hook and loop fasteners, with one side mounted to a flexible strip of plastic, or by using rare earth magnets, which are easily found with sufficient strength, and which may also be mounted with a flexible plastic or rubber pad mounted to at least one opposing side established between the sub-wall and panels.

Figure 7:
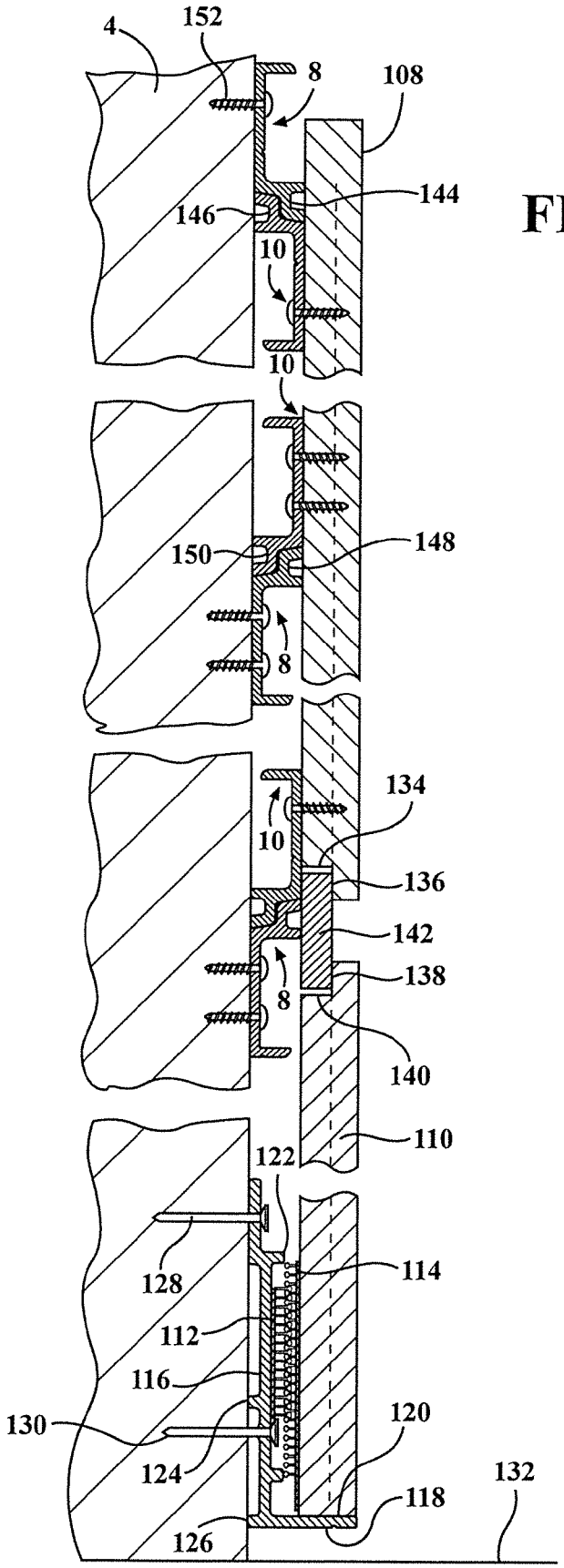
FIG. 7 is a side plan illustration of multiple tier panel to wall mounting arrangement according to a further variant and including an upper locked panel and a lower removably supported panel which is supported at a bottom end by opposing pluralities of reclosable fasteners, including those secured upon an exposed surface of a floor proximate "J" support profile including a bottom projecting lip for supporting a corresponding bottom edge of the lower tier panel.

FIG. 7 is a side plan illustration of multiple tier panel to wall mounting arrangement according to a further variant and including an upper locked panel, see as reconfigured at 108, and a lower removably supported panel (further at 110). The lower panel 110 is supported at a bottom end by opposing pluralities of reclosable fasteners 112 and 114, this including the fasteners 112 secured upon an exposed surface of a floor proximate "J" support profile 116 including a bottom projecting lip 118 with an upper facing ledge surface 120 for supporting a corresponding bottom edge of the lower tier panel 110. As further shown, the "J" profile 116 includes an upper ledge supporting surface 122 and reverse projecting feet support 124 and 126 which bias against the sub-wall surface 4, such as in combination with the installation of mounting fasteners 128 and 130 at an incremental spaced location above a ground surface 132.

Also shown in FIG. 7 is a first version of a rabbit notch profile defined along inside and opposing edges of the upper panel 108 and the lower panel 110, such as defined by inwardly stepped edges 134/136 for panel 108 and further at 138/140 for panel 110. A rectangular cross sectional shaped trim strip 142 is provided and which is supported against an outer profile surface established by the engaging and lowermost tiered rail and clip. The trim strip 142 also seating within the inner opposing and stepped edges 134/136 and 138/140 in the manner shown so that a vertical gap is evident between the upper and lower cross sectional edges of the strip 142 and the opposing surfaces 134 and 140 associated with the panels 108 and 110.

The depiction of FIG. 7 is intended to represent one non-limiting arrangement for mounting a selected tier of panels (e.g. at 108) in a locked arrangement upon the sub-wall 4, and which is accomplished by virtue of the opposing engagement profiles established by the upper pair of rail and clip in comparison to the intermediate located and inverted pair of rail and clip. Specifically, the nesting "U" shaped portions of the uppermost rail and clip engagement (see as referenced at 144 and 146) are reversed by the "U" shaped portions of the intermediate tier defined clip and rail (further at 148 and 150).

Installation of the panel 108 can also be accomplished by sliding laterally so that the "U" shaped portions 146 and 150 of the upper and intermediate tiered clips engage the seating profile surfaces of the rail mounted "U" shaped portions 144 and 148. Also, and by exposing an uppermost fastener (at 152) of the top tier affixed rail 8, removal of this fastener can facilitate lift-off demount-ability of the panel 108. As is further understood, the top tier arrangement of clip and rail can also be reconfigured in a clip to clip engagement in order to permanently secure the panel 108 to the sub-wall 4. The lower panel 110, while also being shown in reduced height, can also incorporate a middle tiered rail to clip mounting configuration (not shown but oriented in the fashion depicted by the uppermost tier of rail and clip) and which is located at a position above the floor located "J" profile 116.

Figure 8:
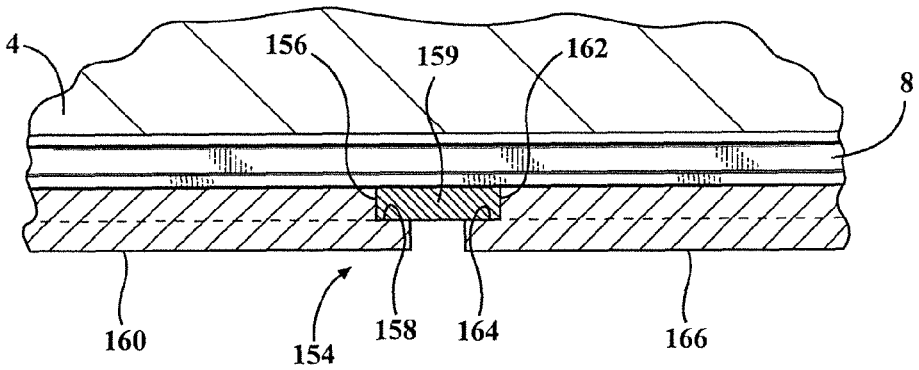
FIG. 8 is a partial plan view of a boundary established between a pair of notched inside edge profiles associated with tiered panels, such as which are mounted according to the several variants of the present invention.

FIG. 8 is a partial view, generally at 154, in side cutaway, of a boundary established between a pair of notched inside edge profiles, similar to as previously depicted in FIG. 7 and which are termed as rabbit notches 156/158 for panel 160 and further at 162/164 for panel 166. Also depicted is a selected and sub-wall secured rail 8, a corresponding nesting clip being hidden on a reverse side of the rail. The use of rubber isolated batten strips, such as which can also be provided at 159 in FIG. 8 or as previously referenced at 142 in FIG. 7, are configured to fill a gap between a pair of panels in a cost-effective installation with damping for high and low frequency vibrations (see co-pending application).

Viewing the several depicted variants, it is easily understood and envisioned that the tiered panels are capable of being mounted according to several variants. Given the above description, the present system and assembly encompasses a variety of mounting applications in which a plurality of profile components are arranged in a number of grid defining configurations in order to securely and dynamically support each panel from its rear face. A double panel profile mounting variant as further illustrated and described herein can exhibit any elongated or height extending direction. Other and additional mounting arrangements contemplate mounting the panels to a horizontally or angularly extending ceiling surface as well as a vertically extending wall surface as depicted.

Non-limiting variants of the panels can also exhibit 6.3 mm thick magnesium oxide board substrates, and flame-resistant polyolefin faux veneers covering the substrate, and a 4 mm flexible spline set between panels to create a vertical reveal between the panels. Additional accessories (not shown) can include divider molding can also be inset on top of an aluminum seam strip. The upper width of a spline feature can exhibit flexible elements, such that it can accommodate building movement and, in this fashion, the rigidly supported wall panels will not be exposed to undo stress or buckling forces, and while still maintaining contact, on either side, with the associated edges of the panels being supported.

Depending upon the mounting application, all screws and mounting hardware are usually concealed within the airspace (or gap) between the inside surface 7 of the panels 6 and the exposed surface of the sub-wall 4, it further being noted that, with the inventive rail and clip configuration, no exposed fasteners are necessary. The ultra-low lift-off design of the inventive bracket additionally permits the individually demountable feature of the panels and also greatly eases the installation proves of each panel, especially in combination with the 10° throat or angle as representatively depicted in FIGS. 2B and 2D between the unengaged brackets.

Any reclosable fasteners can also be oriented ninety degrees from one another so as to maximize the alignment flexibility, while maintaining a constant surface area of engagement between the associated panel (such as previously at 110 in FIG. 7) and the floor proximate located (or "J") profile 116. In one non-limiting application, each fastener location features a minimum of one square inch of fastener engagement.

The panels are secured against the sub-wall 4, such that a mild compressive force as created by the 10° angular and ramped relationship between the bearing surfaces of the rail and clip (again as shown by surfaces 78/82 and 80/84 in FIG. 2D, engage the rail and clip (also referenced as a pair of brackets) together for establishing the panel in a particularly stable mounting arrangement.

Other non-limiting features include the provision of phenolic fasteners for fastening the clips to the inside surfaces of the panels. The panels can also be formed or coated with a high-pressure phenolic material, and in which thread-cutting screws do not penetrate the panel's face and are therefore not visible in the completed installation. It is another feature of the present invention that any such fasteners used with the panels have a major diameter at least 0.020" and preferably 0.030" to 0.050" less than the interior diameter of the holes in the Clip assembly. This is of particular use as shown in FIG. 7 wherein such tolerance between the panel fastener and the clip holes provides a measure of flexibility and movement allowance even within a panel that has been locked by an inverted (locking configuration) uppermost clip and rail assembly. This inverted engaged uppermost clip and rail set is typically used in conjunction with at least one or two engaged pairs of clips and rails below in a single panel.

Additional aspects of the present invention include a degree of forgiveness in the installation process (by virtue of the misalignment accommodating gaps and spacing built into the design of the rail and clip brackets as previously described) and can be designed so that the panels arrive from the original location, with the hardware being shipped separately, thereby reducing logistics requirements from multiple shipping of the typically very heavy and bulky wall panel materials.

According to one non-limiting mounting arrangement, a standard ¼" (6.4 mm) panel headspace allowance incorporated into typical installation layouts allows sufficient clearance for the low-profile design of the inventive bracket for a panel to individually demount from the wall surface. It is also understood that any scale or dimension can be employed in the configuration or sizing of the rails and clips, as well as any suitable combination of mounting hardware being provided within the scope of the invention, such as ranging from a single rail and clip provided for securing each panel to an associated wall surface location, ranging to multiple tiers of nesting or inter-engaging rails and clips provided between the wall surface and panels and arranged for either demounting or affixing the panel to the wall. The present invention further envisions any combination of additional accessories provided in combination with any one or more pair of nesting rails and clip, and again not limited to the intermediate extending wall support profiles shown in FIGS. 4A-4B, with or without friction pad support or the reclosable fasteners depicted in the several views in combination with the middle extending profiles or floor located J profiles.

Having described my invention, other and additional preferred embodiments will become apparent to those skilled in the art to which is pertains and without deviating from the scope of the appended claims.

I claim:

1. An assembly for securing a panel to a wall surface, comprising:

an elongated rail adapted to being secured in extending fashion along the wall surface;

a clip adapted to being secured to a rear surface of the panel, said clip engaging said rail to mount the panel to the wall surface;

said rail and clip each exhibiting a similar cross sectional profile, with each including at least one mating and inclined support surface for redirecting a weight of the panel inwards toward the wall surface;

each of said rail and clip further having a main planar body having an exterior surface and an interior surface, an inwardly angled edge configured along one length extending end of said body, an engagement profile incorporating said mating and inclined support surface extending from and along the other length extending end of said main body;

said engagement profile further comprising a generally "U" shaped profile which is displaced a distance inwardly from said interior surface via an inner ledge;

a centerline extending through said inner ledge establishing a perpendicular with exterior and interior surfaces;

a connecting web extending from a midpoint of said inner ledge and establishing a perpendicular with an inner ledge centerline, an outer ledge including a slightly outwardly angled profile relative to said inner ledge which extends at an angle relative to a horizontal line through a central location of said outer ledge; and a "U" shaped profile of said rail extending from the wall in a first orientation and receiving a "U" shaped profile of said clip extending from the panel in a second opposing orientation, each of said opposing "U" shaped profiles having a pair of vertically spaced and opposing surfaces defining a downwardly angled and ramped engagement.

2. The assembly as described in claim 1, said downwardly angled engagement further comprising an angle in a range of between 91° to 179° .

3. The assembly as described in claim 1, further comprising a pair of height extending support surfaces extending between said pairs of vertically spaced surfaces, a gap between said height extending surfaces providing thermal coefficient compensation between said rail, clip and panel, as well as providing misalignment compensating for settling of the sub-wall.

4. The assembly as described in claim 1, further comprising V" notched drill lines extending across said main body to facilitate application of mounting fasteners.

5. The assembly as described in claim 4, further comprising apertures defined in said main planar body which are aligned with a first of said notched drill lines, notch indicating locations being located on an exterior surface of said clip aligning with a second of said notched drill lines for facilitating installing said clip in a reverse locking configuration.

6. The assembly as described in claim 1, further comprising at least one mating pair of supports arranged at locations between the wall and panel in spaced apart fashion from said mating rail and clip.

7. The assembly as described in claim 6, the panel further including an upper panel and a lower panel, further comprising a first set of rails and clips for mounting the upper panel and a second set of rails and clips for mounting the lower panel to the wall.

8. The assembly as described in claim 7, further comprising a height of said engagement profile established between said engaging rails and clips being less than a vertically extending gap established between the panels.

9. The assembly as described in claim 7, said mating pair of supports further comprising opposing pairs of reclosable fasteners associated with the lower panel.

10. The assembly as described in claim 9, further comprising a floor proximate "J" support profile adapted to mount to the wall and including a bottom projecting lip with an upper facing ledge surface adapted for supporting a corresponding bottom edge of the lower panel.

11. The assembly as described in claim 10, said "J" support profile further comprising an upper ledge supporting surface and reverse projecting feet support which are adapted to bias against the wall, such as in combination with the installation of mounting fasteners through said "J" support profile at an incremental spaced location above a ground surface.

12. The assembly as described in claim 7, further comprising a notch profile defined along inside and opposing edges of each of the upper panel and the lower panel, a trim strip seating within the opposing notched profiles to cover a gap between the panels.

13. The assembly as described in claim 1, further comprising upper and lower spaced apart pairs of engaging rails and clips, said upper engaging pair orienting in a first direct, said lower engaging pair orienting in a second direction such that the panel is adapted to being locked in place upon the wall.

14. An assembly for securing a panel to a wall surface, comprising:

a pair of upper and lower elongated rails adapted to being secured in extending and vertically spaced apart fashion along the wall surface;

a pair of upper and lower clips adapted to being secured to a rear surface of the panel, said clips engaging said rails to mount the panel to the wall surface;

said rails and clips each exhibiting a similar cross sectional profile, with each including at least one mating support surface for redirecting a weight of the panel inwards toward the wall surface;

each of said rails and clips further including a main planar body having an exterior surface and an interior surface, an edge configured along one length extending end of said body, an engagement profile incorporating said support surface extending from and along the other length extending end of said main body;

a centerline extending through an inner ledge of said engagement profile and establishing a perpendicular with exterior and interior surfaces, a connecting web extending from a midpoint of said inner ledge and establishing a perpendicular with an inner ledge centerline; and said upper engaged rail and clip profiles being inverted relative to lower engaged rail and clip profiles, such that the panel cannot be removed without removing said upper rail from the wall, said upper rail protruding beyond the uppermost edge of the panel.

* * * * *